US007904977B1

(12) United States Patent
Singh

(10) Patent No.: US 7,904,977 B1
(45) Date of Patent: Mar. 15, 2011

(54) SAFETY SHEET

(76) Inventor: Neeraj Singh, McDonough, GA (US)

( * ) Notice: Subject to any disclaimer, the term of this patent is extended or adjusted under 35 U.S.C. 154(b) by 0 days.

(21) Appl. No.: 12/803,090

(22) Filed: Jun. 18, 2010

(51) Int. Cl.
*A47C 21/08* (2006.01)

(52) U.S. Cl. ..... 5/494; 5/424; 5/497

(58) Field of Classification Search ..... 5/424–425, 5/482, 485, 494, 497
See application file for complete search history.

(56) References Cited

U.S. PATENT DOCUMENTS 4,873,734 A 10/1989 Pollard
5,473,785 A 12/1995 Lager et al.
6,754,921 B2 6/2004 Gill-Barajas
6,848,130 B1 * 2/2005 Wilson ..... 5/425
7,086,101 B2 * 8/2006 Welch et al. ..... 5/428
7,107,635 B2 * 9/2006 Henry et al. ..... 5/424

* cited by examiner

*Primary Examiner* — Fredrick Conley
(74) *Attorney, Agent, or Firm* — Crose Law LLC; Bradley D. Crose

(57) ABSTRACT

The safety sheet of the present invention may include a bed sheet with sleeves along one or more sides. The sleeves may be continuous or slotted and may accommodate inserts constructed of a material soft enough to avoid injury yet sturdy enough to provide an effective barrier to lateral motion of a bed's occupant. The safety sheet may include solid or hollow inserts. Portability of the safety sheet may be maximized by the use of inflatable/deflatable inserts. Inserts may vary in size and shape, and the sleeves may vary in size to accommodate a range of insert sizes. Alternatively, the sleeves may be stuffed with soft materials such as socks or other clothing when inserts are unavailable. The safety sheet may be reversed with inserts in place for aesthetic and comfort purposes or without inserts to hide the sleeves when inserts are no longer needed.

14 Claims, 12 Drawing Sheets

SAFETY SHEET

FIELD OF THE INVENTION

The present invention relates to the field of bed safety, and more particularly to a highly customized bed sheet which can be used to lessen the possibility that an infant, child, older adult, or disabled person sleeping on a mattress will inadvertently roll off the mattress and sustain injury from the subsequent fall.

BACKGROUND OF THE INVENTION

With regard to infant safety, although cribs with protective siding and the like exist for accommodating sleeping infants, cribs generally do not lend themselves to easy portability, especially when traveling by plane or crowded automobile. When an infant-safe bed such as a crib is not available, there is always the possibility that an infant may need to be put down for a nap or even a full night's sleep on a regular mattress without protective siding. This can require an adult to sleep with the infant through the night to ensure that the infant does not roll over the side of the mattress and sustain a fall and subsequent injury, which would likely result in very little sleep for the accompanying adult. Alternatively, in the absence of an infant-safe bed, a child may have to be placed on a pallet on the floor for sleeping to eliminate the possibility of a fall, which may ultimately be uncomfortable and may consequently mean very little sleep for the infant.

Additionally, child safety can be a challenge when transitioning a toddler from a in infant-safe bed to a regular mattress. For a child not accustomed to a bed without safety boundaries, multiple falls from the bed may be incurred before the child becomes trained to stay a safe distance from the edge of the mattress during sleep. Further, older children, people with disabilities, and older adults may also incur the possibility of falling from the bed if they lose or are unable to acquire the instinct that prevents them from tumbling over the side as they move about during sleep.

Free-standing safety rails may be purchased for use with a regular mattress and generally vary in the means by which they may be attached to the mattress. Some of the more commonly available safety rails includes flanges that may be inserted between a mattress and box spring to hold the safety rail in place so that it extends a given number of inches upward beyond the horizontal surface of the mattress to prevent falls. Use of this safety device with heavier children or children who are extremely active during sleep may result in lateral displacement of this kind of safety device and subsequent falls.

Moreover, if a child were to land atop the dislodged safety rail, further and more serious injury could result. Additionally, because most currently available safety rails are constructed of rigid materials, a child who inadvertently rolls into the rail while sleeping may be injured. Depending on the design of the safety railing, it is possible that a child may even become entangled in the railing, another situation that may cause the child to be hurt.

While many of the safety rails currently available are shorter than the mattresses to which they are to be attached (permitting a child to get into and out of bed by going around the railings rather than climbing over them), children may view the railings as a toy and may be tempted to climb over them when entering and exiting the bed, thereby increasing the potential for falls and injury. Finally, most commercially available safety rails are not aesthetically pleasing and typically prevent one from making the bed fully without removing the safety rail altogether. Installing and removing the rail repeatedly can be both cumbersome and time-consuming.

Elongate bolsters and pillows are also available for use as potential safety devices to prevent falls from a bed; however, these can be easily ejected from the bed by even the slightest child, resulting in a loss of any protection against falls that such an item might have afforded. While some versions include straps by which the bolster or pillow may be attached to a headboard and footboard of a bed, every bed does not include a headboard and/or footboard by which to attach such a device. Moreover, there is a possibility that even an attached bolster could be displaced to allow a child to slip underneath the bolster so that a fall results.

Portability is yet another issue with most commercially available safety devices. Free-standing rails are cumbersome to pack and carry, and neither bolsters nor pillow-type devices of any appreciable size can be easily transported from one place to the next when traveling.

What is therefore needed is a safety system which is affordable yet completely portable, easy to assemble and/or dissemble, aesthetically integrable, and consistently reliable at deterring the occupant of a bed/mattress from falling over the edge of the mattress while sleeping. The ideal safety system may include a sheet having pockets or sleeves on one or more sides into which soft or semi-soft side guards may be inserted. The side guards may extend a given distance above the top surface of the mattress to create a barrier on one or more sides of the mattress which may serve to deter an occupant of the bed from rolling completely over the edge of the mattress should he/she migrate near the edge of the mattress during sleep.

SUMMARY OF THE INVENTION

The safety sheet of the present invention may include a bed sheet which may be fitted and may also be sized for use with any mattress (king, queen, double, single, twin, etc.). The safety sheet may include pockets or sleeves along one or more sides which may be formed at the time the bed sheet is constructed or may be manufactured separately and attached to the bed sheet either prior to marketing or after-market by sewing, snaps, velcro, or some other means of attachment. The pockets or sleeves may accommodate guard inserts which may be constructed of a material such as closed cell foam or any other similar material which is semi-soft to avoid injury or entanglement on contact but is not so highly compressible that it cannot be an effective barrier to lateral motion of a bed's occupant. Inflatable guard inserts may also be available which may be removed and deflated for travel purposes, making the safety sheet of the present invention compactable and therefore highly portable. The guard inserts may vary in size and shape depending on the size of the bed's occupant, and the pockets or sleeves on the sheet likewise may vary in size to accommodate the guards inserts. Similarly, multiple small diameter inserts may be used instead of one large insert. Also, a swim noodle or similar object could be substituted, as could a sleeve full of smaller objects such as packing beads or peanuts or other small foam or similar objects. Generally, the size range of the inserts may begin at approximately 2 inches in diameter as a matter of functionality, since an insert less than about 2 inches may not prevent lateral movement of a bed's occupant. Alternatively, the sleeves may include slits to allow for insertion of short guard inserts or even objects such as socks or other clothing where guard inserts are not available.

The safety sheet of the present invention may also be reversible so that it may, at a user's option, be used with guard inserts as described above to restrict lateral movement of a bed's occupant, or, alternatively, may be reversed and used without inserts as a typical bed sheet (which may be fitted or flat) would be used. This allows a user to maximize the safety sheet's utility both in general and when there is no longer a need to use it for safety reasons, for example when a child has outgrown the need for it.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
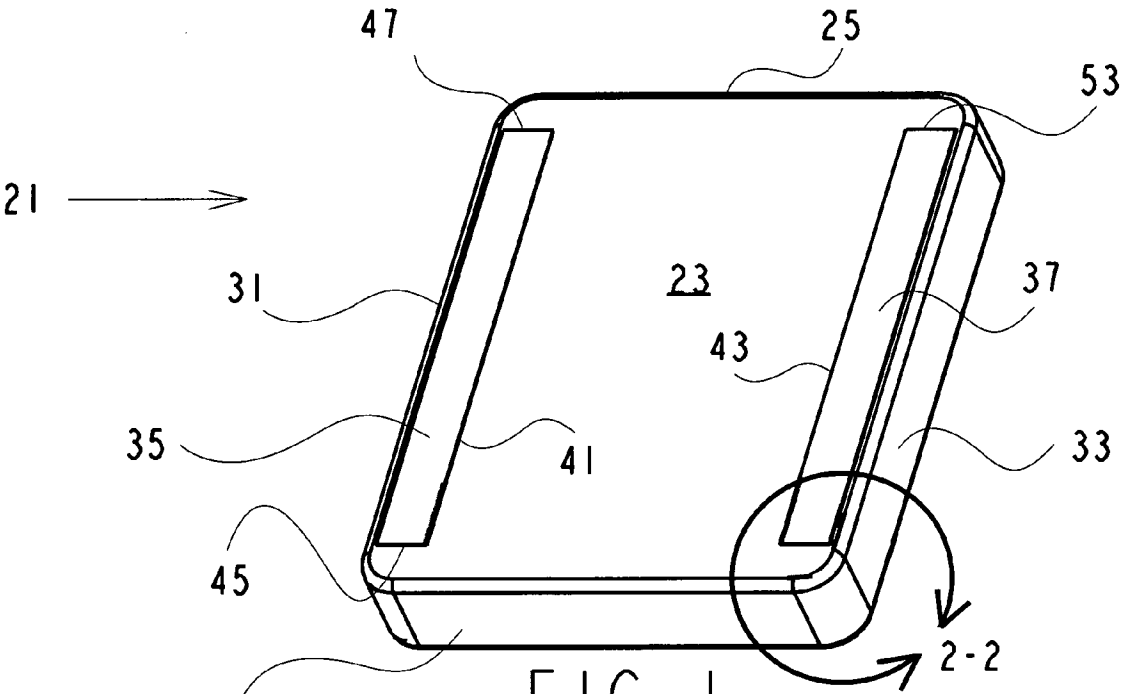
FIG. 1 is perspective top view of a first embodiment of the safety sheet of the present invention fitted onto a mattress and having a pair of empty sleeves, each of which is attached to the safety sheet by a single seam.

The invention, its configuration, construction, and operation will be best further described in the following detailed description, taken in conjunction with the accompanying drawings in which:

FIG. 1 is perspective top view of a first embodiment 21 of the safety sheet of the present invention as it might appear when fitted onto a mattress. Safety sheet 21 may have a main surface 23, a first end 25, a second end 27, a first side 31 and a second side 33. Safety sheet 21 may include an elasticized band or elasticized straps (not illustrated) adjacent the edges of the corners for securing it onto a mattress just as any other commonly available fitted sheet would be applied to a mattress. Safety sheet 21 may include a pair of sleeves 35 and 37 which are illustrated as empty in FIG. 1. Sleeve 35 may be attached to the top of main surface 23 adjacent first side 31 by a single seam 41 in order to avoid stressing the material of the sheet itself upon insertion of a stiffening object into the sleeve 35. In addition, sleeve 35 may be made of expandable elastic material capable of attaining an effective diameter much greater than its "at-rest" diameter. Likewise, sleeve 37 may be oppositely disposed from sleeve 35 and may be attached to top of main surface 23 adjacent second side 33 by a single seam 43. First sleeve 35 may have a first end 45 and a second end 47; likewise, second sleeve 37 may have first end 51 and second end 53. First ends 45 and 51 may be open as shown or may include flaps or other closures; likewise, second ends 47 and 53 may be open, closed, or closeable using flaps, snaps, ties or other similar kinds of closures (similarly not shown).

Figure 2:
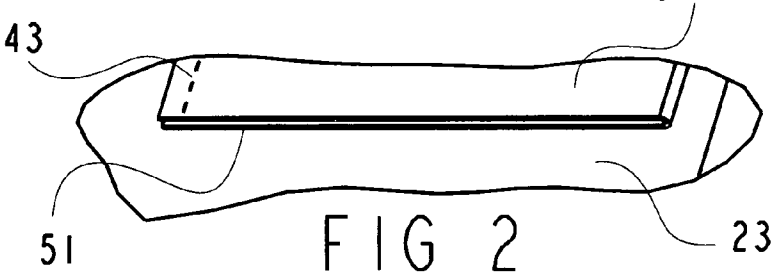
FIG. 2 is a view along line 2-2 of FIG. 1 which illustrates in detail the single-seam attachment of one of the pair of sleeves to the safety sheet.

FIG. 2 is a view along line 2-2 of FIG. 1 which illustrates in detail seam 43 by which second sleeve 37 may be attached to safety sheet 21. This configuration may be achieved by folding a length of material in half lengthwise so that both loose ends are secured by a single seam such as seam 43. Similarly, this configuration may be achieved by attaching a tube of material to the top of main surface 23 of safety sheet 21 using a single seam such as seam 43 or by pinching a surplus of material to form a sleeve and subsequently securing the shape of the sleeve with a seam such as seam 43. Although seams 41 and 43 are illustrated as single seams in FIGS. 1 and 2, it is conceivable that more than one seam may be present, for example where additional reinforcement may be necessary or desired. Moreover, seams 41 and 43 may be sewn seams or seams which result from gluing, snapping, utilizing a hook and eye attachment, zipping, fusing or any other means of attachment which would result in longitudinally fixing sleeves 35 and 37 to the top of main surface 23 of safety sheet 21.

Figure 3:
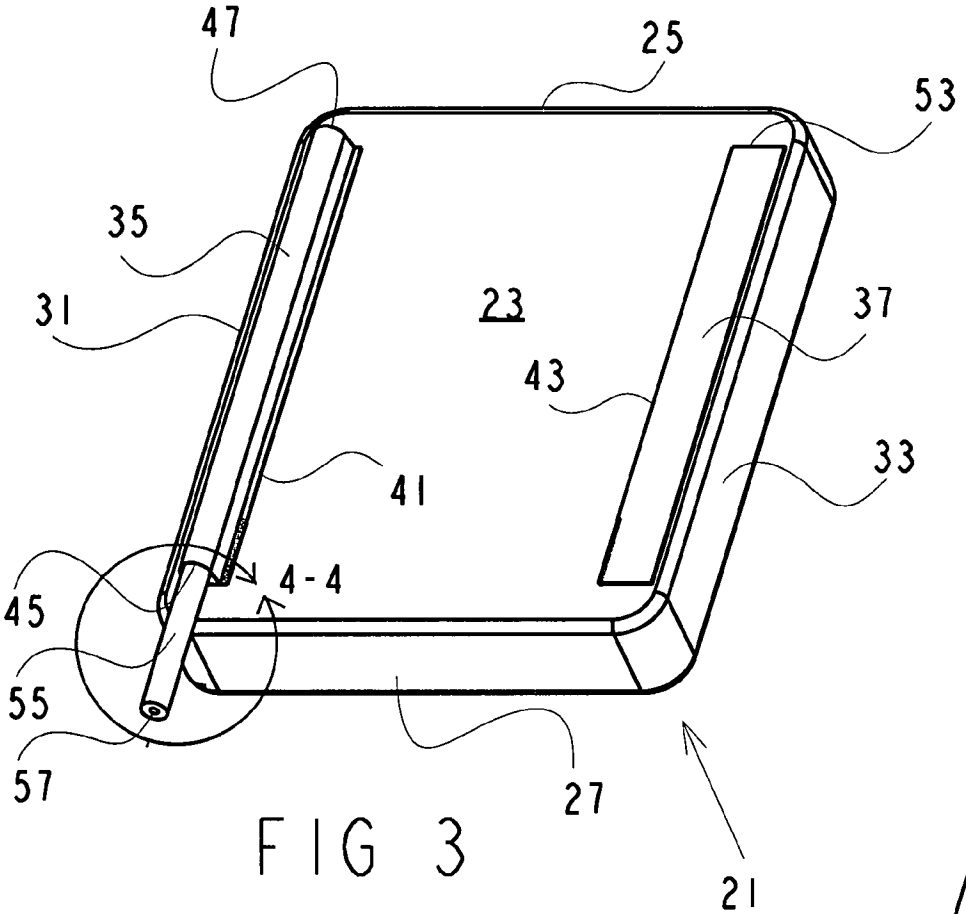
FIG. 3 is a perspective top view of the safety sheet of FIG. 1 which illustrates one empty sleeve and one sleeve partially containing an insert.

FIG. 3 is a perspective top view of the safety sheet 21 of FIG. 1 which illustrates second sleeve 37 as empty but illustrates first sleeve 35 partially containing a hollow insert 55. Hollow insert 55 may be hollow as illustrated by an opening 57 but may just as easily be solid. Ideally, hollow insert 55 may be made of a material which is soft enough to prevent injury on contact but which is firm enough to create a barrier to lateral movement and possible subsequent fall and injury by a bed's occupant, such as a dense or closed-cell foam or plastic. Additionally, hollow insert 55 may be an inflatable member for maximum transportability of safety sheet 21. Hollow insert 55 may also ideally be constructed of a material which has a friction coefficient which is low enough to allow smooth and easy insertion and removal of the hollow insert 55 into and from first sleeve 35.

Figure 4:
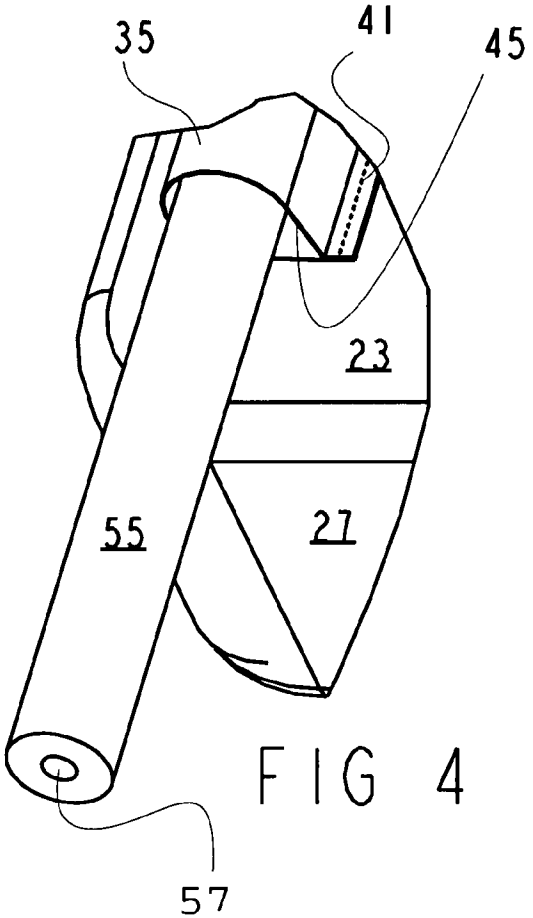
FIG. 4 is a view along line 4-4 of FIG. 3 which illustrates in detail the sleeve partially containing an insert.

FIG. 4 is a view along line 4-4 of FIG. 3 which illustrates in more detail first sleeve 35 partially containing hollow insert 55. FIG. 4 also illustrates opening 57 on hollow insert 55 and seam 41 adjacent hollow insert 55.

Figure 5:
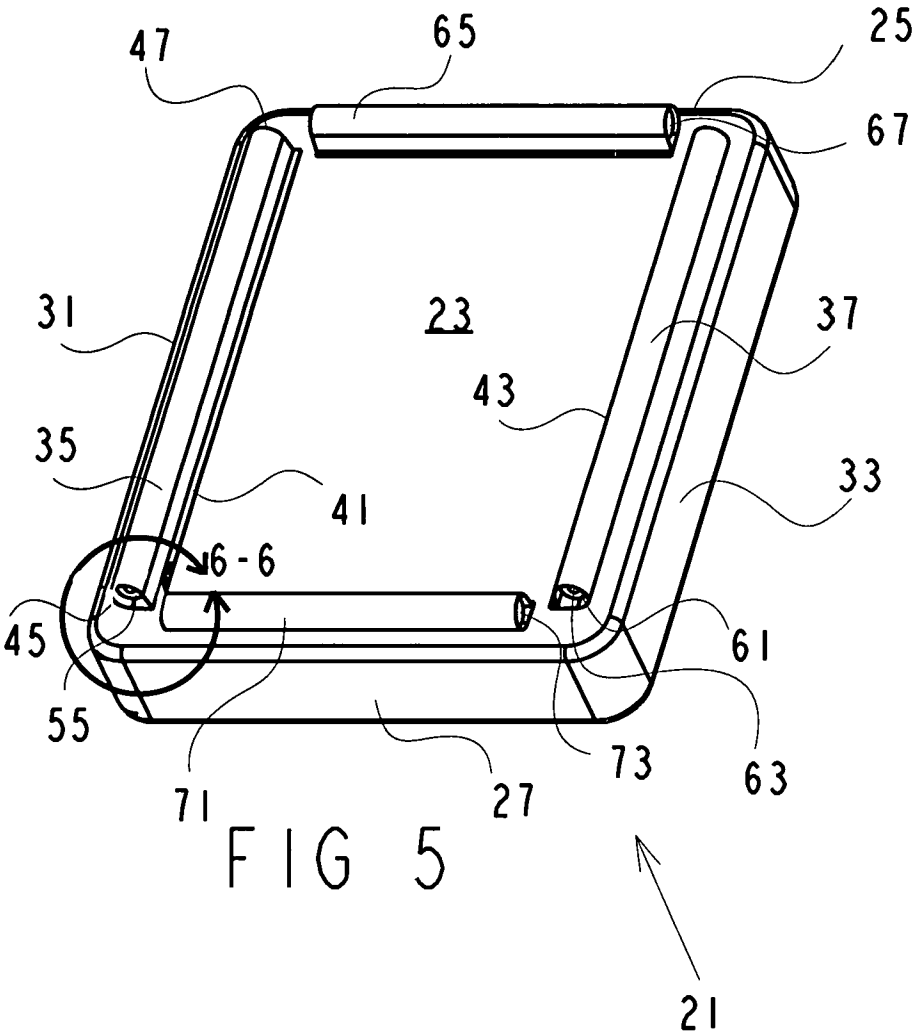
FIG. 5 is a top perspective view of the safety sheet of FIGS. 1 through 4 wherein each sleeve fully contains an insert.

FIG. 5 is a top perspective view of the safety sheet 21 of FIGS. 1 through 4 which illustrates first sleeve 35 fully containing insert 55 and also illustrates second sleeve 37 fully containing hollow insert 61 with opening 63. FIG. 5 further illustrates safety sheet 21 as having a third sleeve 65 containing a solid insert 67 adjacent first end 25 and a fourth sleeve 71 containing a solid insert 73 adjacent second end 27. This may be an ideal configuration where the safety sheet 21 will be used with younger children and infants who may move about more freely during sleep and who may therefore incur as much risk of falling from either of first and second ends 25 and 27 as from first and second sides 31 and 33. Any of inserts 55, 61, 67 and 73 may be solid, hollow, or inflatable, may be any size or cross-section, and may be customized to allow the use of safety sheet 21 to deter falls for nearly any size of bed occupant from infant to adult.

Figure 6:
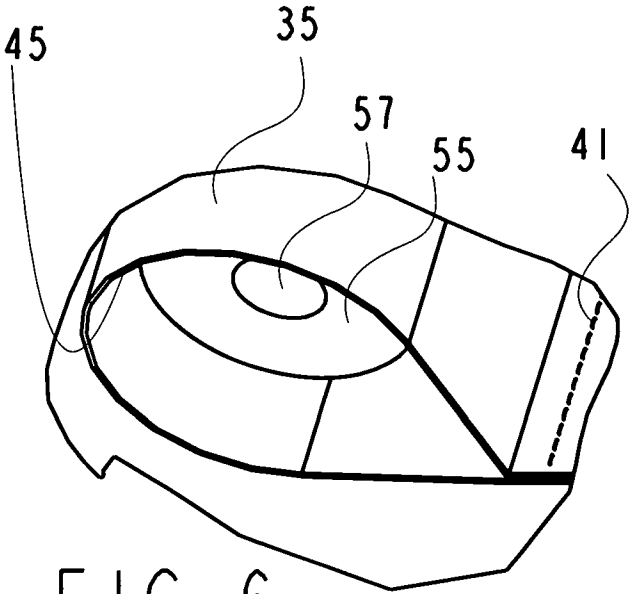
FIG. 6 is a view along line 6-6 of FIG. 5 which illustrates in detail one of the sleeves fully containing an insert.

FIG. 6 is a view along line 6-6 of FIG. 5 which illustrates in detail first sleeve 35 containing hollow insert 55. FIG. 6 also illustrates opening 57 on hollow insert 55 and seam 41 adjacent sleeve 35. Although hollow insert 55 is illustrated as cylindrical in FIGS. 1 through 6, any of inserts 55, 61, 67, and 73 may be any of a number of different shapes such as square or polygonal.

Figure 7:
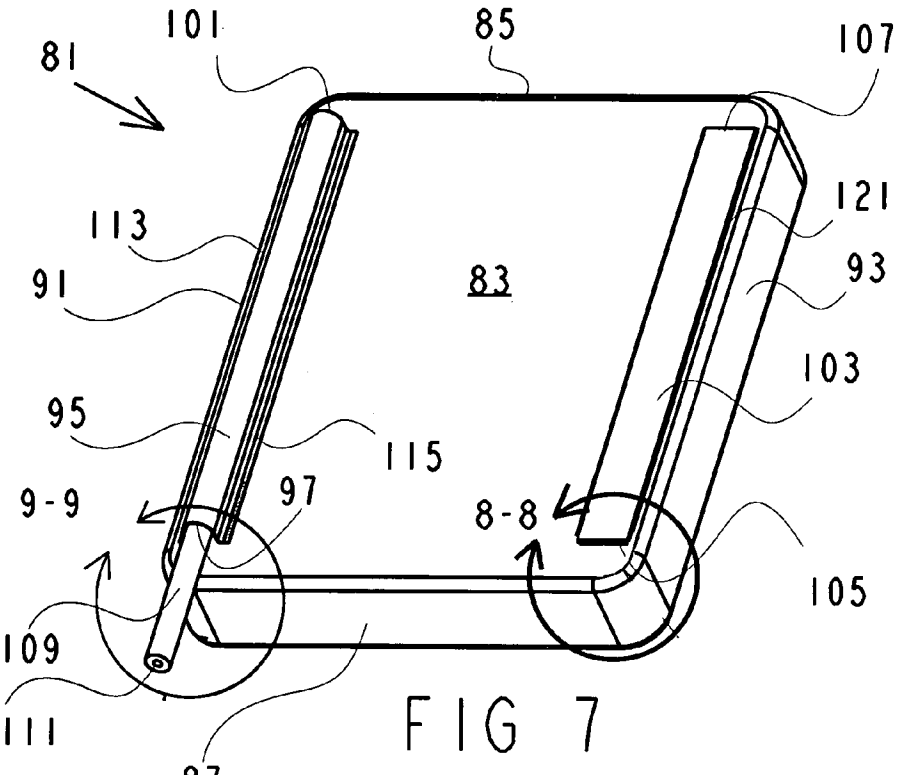
FIG. 7 is a top perspective view of a second embodiment of the safety sheet of the present invention fitted onto a mattress and having a pair of sleeves, one of which is empty, one of which partially contains an insert, and both of which are attached to the safety sheet by a pair of seams.

FIG. 7 is a top perspective view of a second embodiment 81 of the safety sheet of the present invention as it might appear fitted onto a mattress. Safety sheet 81 may have a main surface 83, a first end 85, a second end 87, a first side 91 and a second side 93. Safety sheet 81 may be fittable onto a mattress just as any other sheet would be applied to a mattress. Safety sheet 81 may include a first sleeve 95 having first and second ends 97 and 101, respectively, and a second sleeve 103 having first and second ends 105 and 107 respectively. Although second sleeve 103 is illustrated as empty, sleeve 95 is shown partially containing an inflatable insert 109 with opening 111. Safety sheet 81 differs from safety sheet 21 in that first sleeve 95 may be attached to top of main surface 83 of safety sheet 81 by a first seam 113 and a second seam 115 oppositely disposed from first seam 113 such that inflatable insert 109 is situated between first and second seams 113 and 115 when inserted into sleeve 95. Likewise, second sleeve 103 may be attached to top of main surface 83 of safety sheet 81 by first seam 117 and second seam 121 oppositely disposed from first seam 117. This configuration may be accomplished by securing each side of a single strip of material as shown or may be achieved by securing each side of a tubular length of material.

Just as with safety sheet 21 of FIGS. 1 through 6, first ends 97 and 105 of sleeves 95 and 103 (respectively) may be open as shown or may include flaps or other closures; likewise, second ends 101 and 107 of sleeves 95 and 103 may be open, closed, or closeable. As with safety sheet 21, safety sheet 81 may include additional sleeves adjacent first and second ends 85 and 87 where greater protection from falls is desired.

Figure 8:
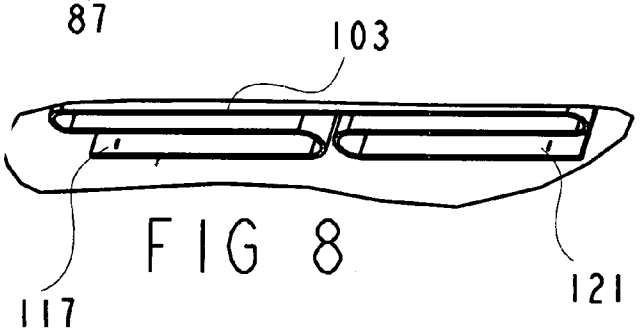
FIG. 8 is a view along line 8-8 of FIG. 7 which illustrates in detail the dual-seam attachment of one of the pair of sleeves to the safety sheet.

FIG. 8 is a view along line 8-8 of FIG. 7 which illustrates in detail the dual-seam attachment of second sleeve 103 to the top of main surface 83 of safety sheet 81 by first seam 117 and second seam 121.

Figure 9:
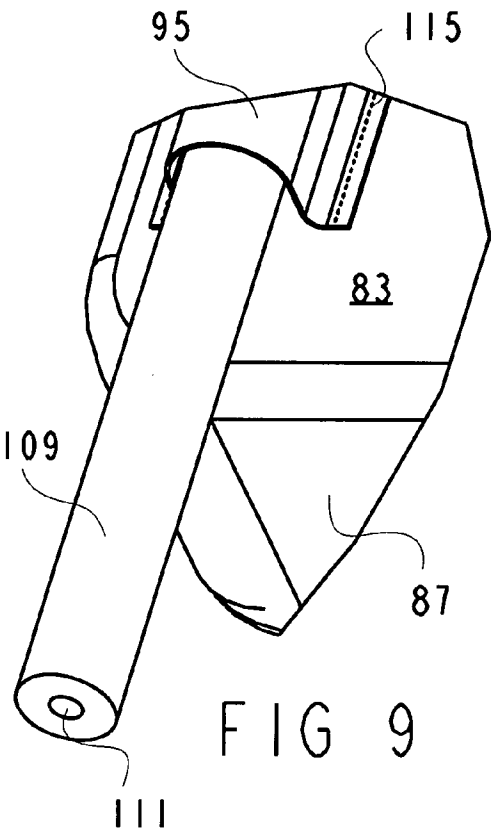
FIG. 9 is a view along line 9-9 of FIG. 7 which illustrates in detail the sleeve partially containing an inflatable insert.

FIG. 9 is a view along line 9-9 of FIG. 7 which illustrates in detail the dual seam attachment of first sleeve 95 to the top of main surface 83 of safety sheet 81. FIG. 9 illustrates partially contained inflatable insert 109 with opening 111. Second seam 115 adjacent inflatable insert 109 is also visible in FIG. 9.

Figure 10:
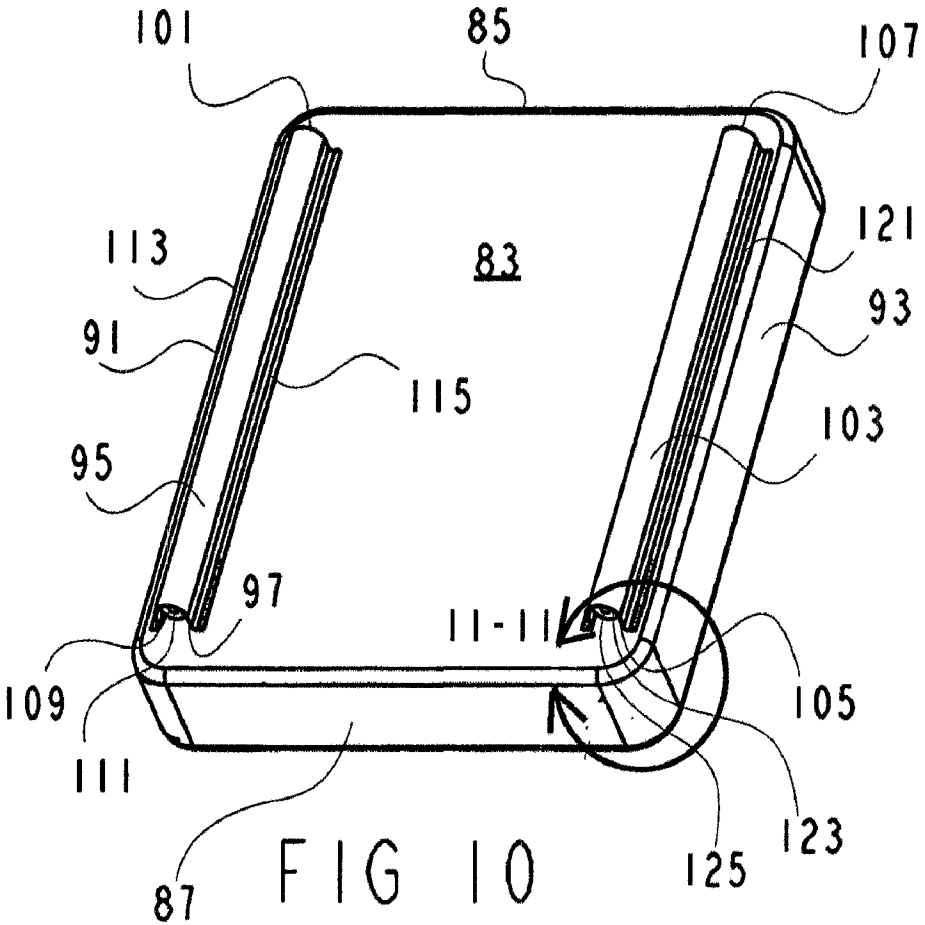
FIG. 10 is a view of the safety sheet of FIG. 8 in which each of the sleeves is illustrated as fully containing an insert; and, FIG. 11 is a view along line 11-11 of FIG. 10 which illustrates in detail one of the sleeves fully containing an insert.

FIG. 10 is a top perspective view of the safety sheet of FIG. 8 in which first sleeve 95 fully contains inflatable insert 109 and second sleeve 103 also contains an insert 123 with opening 125. Like insert 109, insert 123 may be inflatable.

Figure 11:
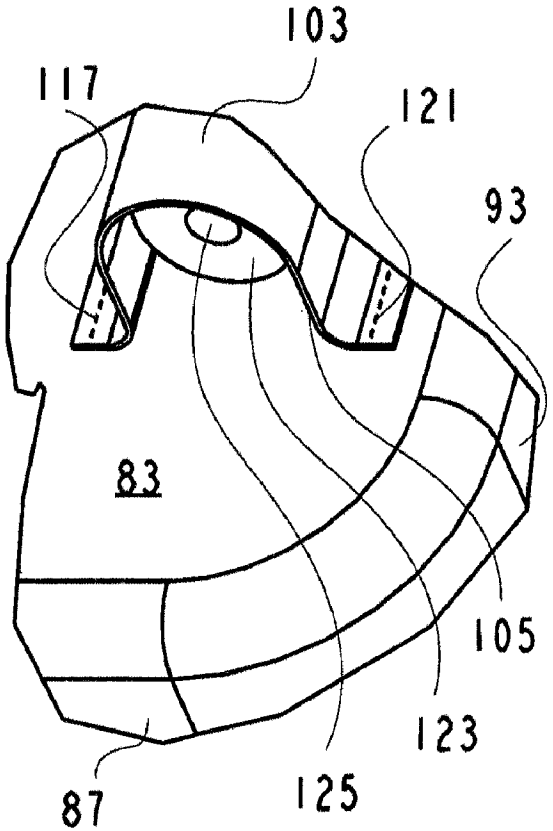

FIG. 11 is a view along line 11-11 of FIG. 10 which illustrates in detail insert 123 fully contained by second sleeve 103 and flanked by first seam 117 and second seam 121.

Figure 12:
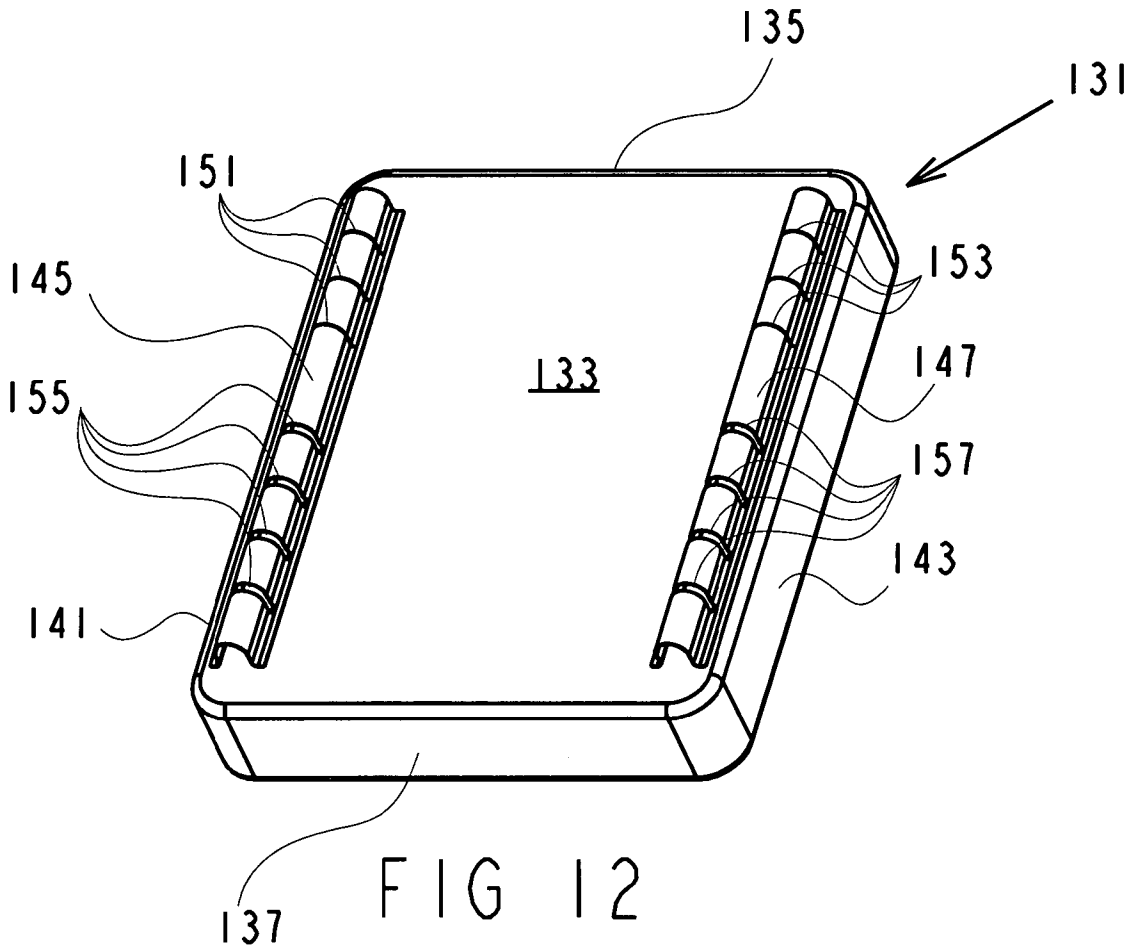
FIG. 12 top perspective view of a third embodiment 131 of the safety sheet of the present invention having slotted and/or slitted sleeves.

FIG. 12 top perspective view of a third embodiment 131 of the safety sheet of the present invention as it might appear fitted onto a mattress. Safety sheet 131 may have a main surface 133, a first end 135, a second end 137, a first side 141 and a second side 143. Safety sheet 131 may include a first sleeve 145 and a second sleeve 147. Sleeves 145 and 147 are illustrated as having a series of slits 151 and 153, respectively, across part of their length, and a series of slots, 155 and 157, respectively, across their remaining lengths. Sleeves 145 and 147 may be constructed entirely of elastic, may have elastic and non-elastic portions, or may be non-elastic but expandable to accommodate inserts (not illustrated in FIG. 12). Alternatively, slits 151 and 153 or slots 155 and 157 may allow a user to stuff sleeves 145 and 147 with soft objects such as socks or underwear where manufactured inserts are unavailable for whatever reason. Additionally, slits 151/153 and slots 155/157 may prevent lint from collecting in sleeves 145 and 147.

Figure 13:
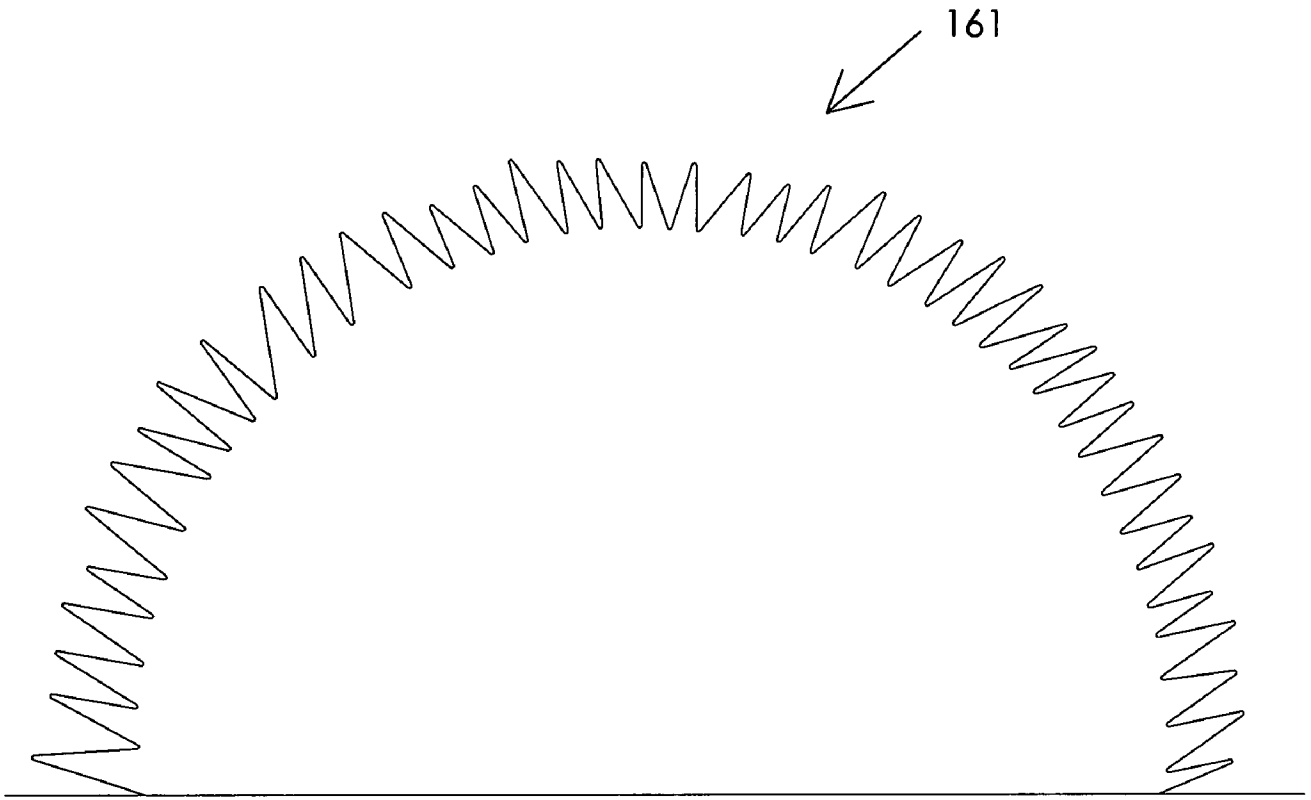
FIG. 13 is a cross sectional view a fully elastic sleeve.

FIG. 13 is a cross sectional view of a sleeve 161 such as any of the sleeves illustrated in FIGS. 1 through 12 which is fully elastic to allow for insertion of a wide range of insert sizes. This may be a practical option for growing children, as use of an elasticized sleeve would prevent a user from having to re-purchase a sheet as the child grows and requires larger inserts to prevent lateral motion.

Figure 14:
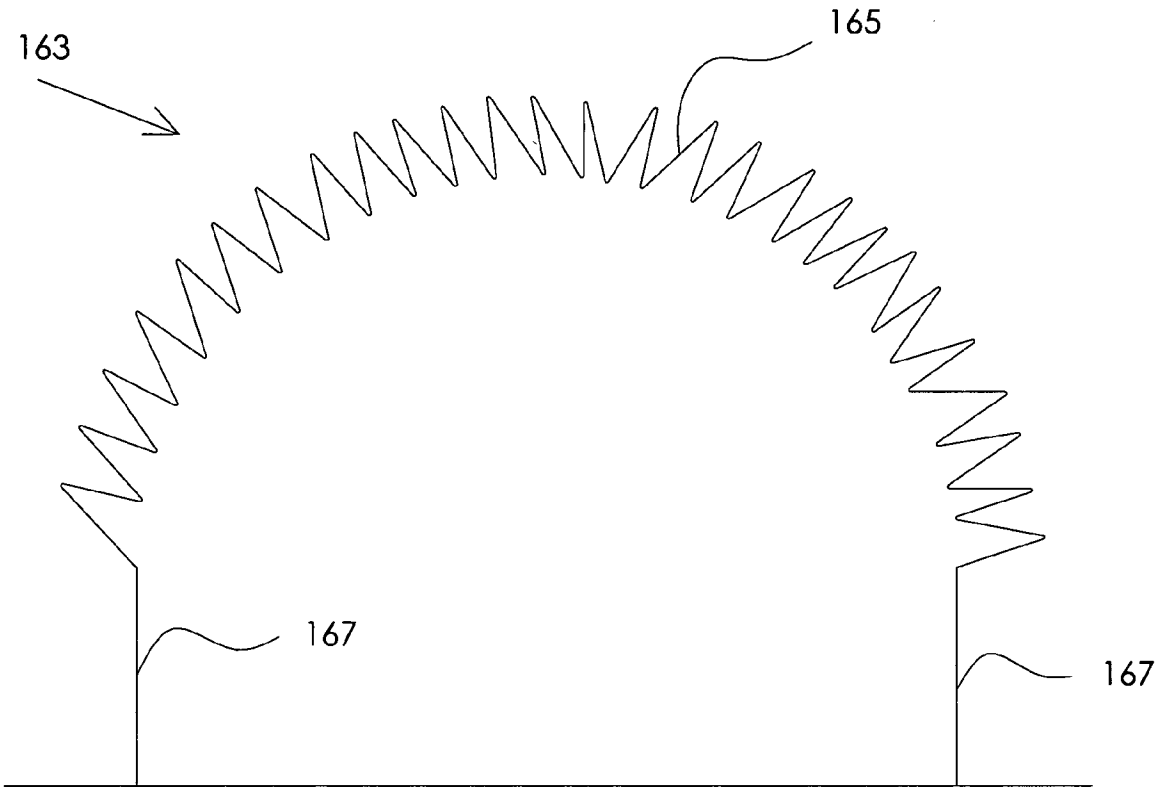
FIG. 14 is a cross sectional view of a partially elastic sleeve.

FIG. 14 is a cross sectional view of a sleeve 163 such as any of the sleeves illustrated in FIGS. 1 through 12 which includes an elastic portion 165 and a non-elastic portion 167.

Figure 15:
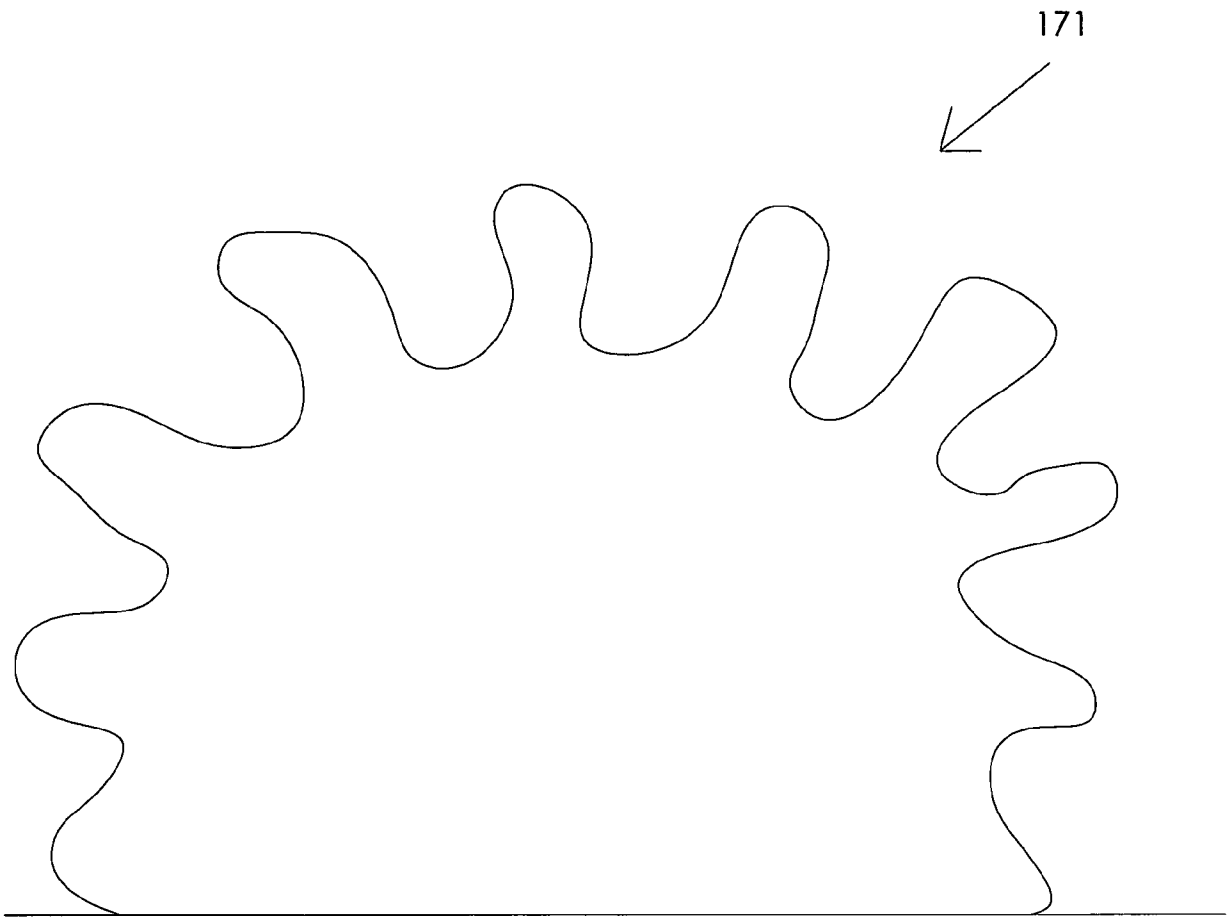
FIG. 15 is a cross-sectional view of a non-elastic expandable sleeve.

FIG. 15 is a cross-sectional view of a sleeve 171 such as any of the sleeves illustrated in FIGS. 1 through 12 which is non-elastic yet is still expandable to accommodate a range of manufactured inserts or to accommodate other materials capable of expanding sleeve 171 where a manufactured insert is unavailable.

Figure 16:
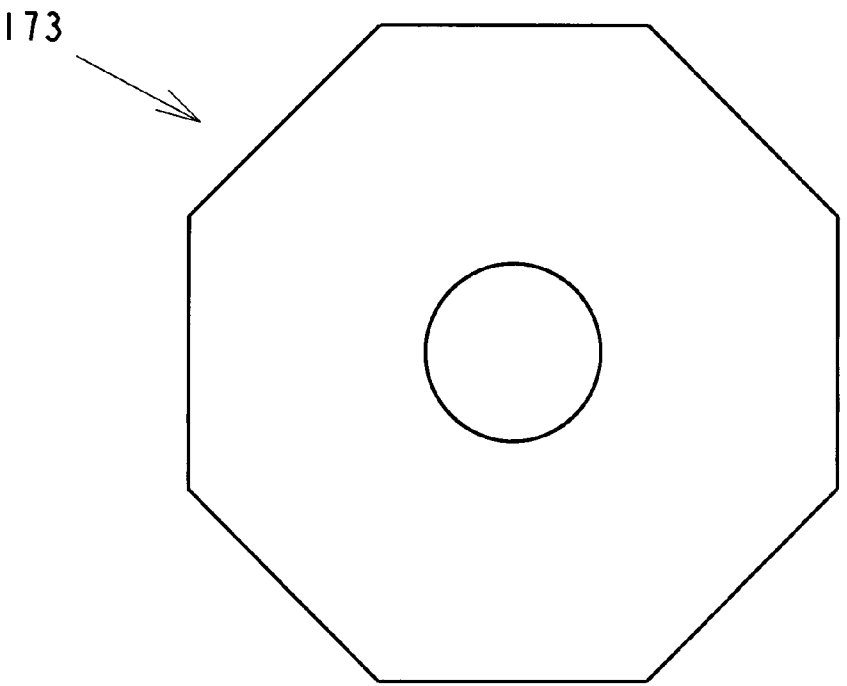
FIG. 16 is a cross sectional view of an octagonal insert.

FIG. 16 is a cross sectional view of a manufactured insert 173 which is octagonal. Although insert 173 is illustrated as octagonal, it may be a polygon having any number of sides.

Figure 17:
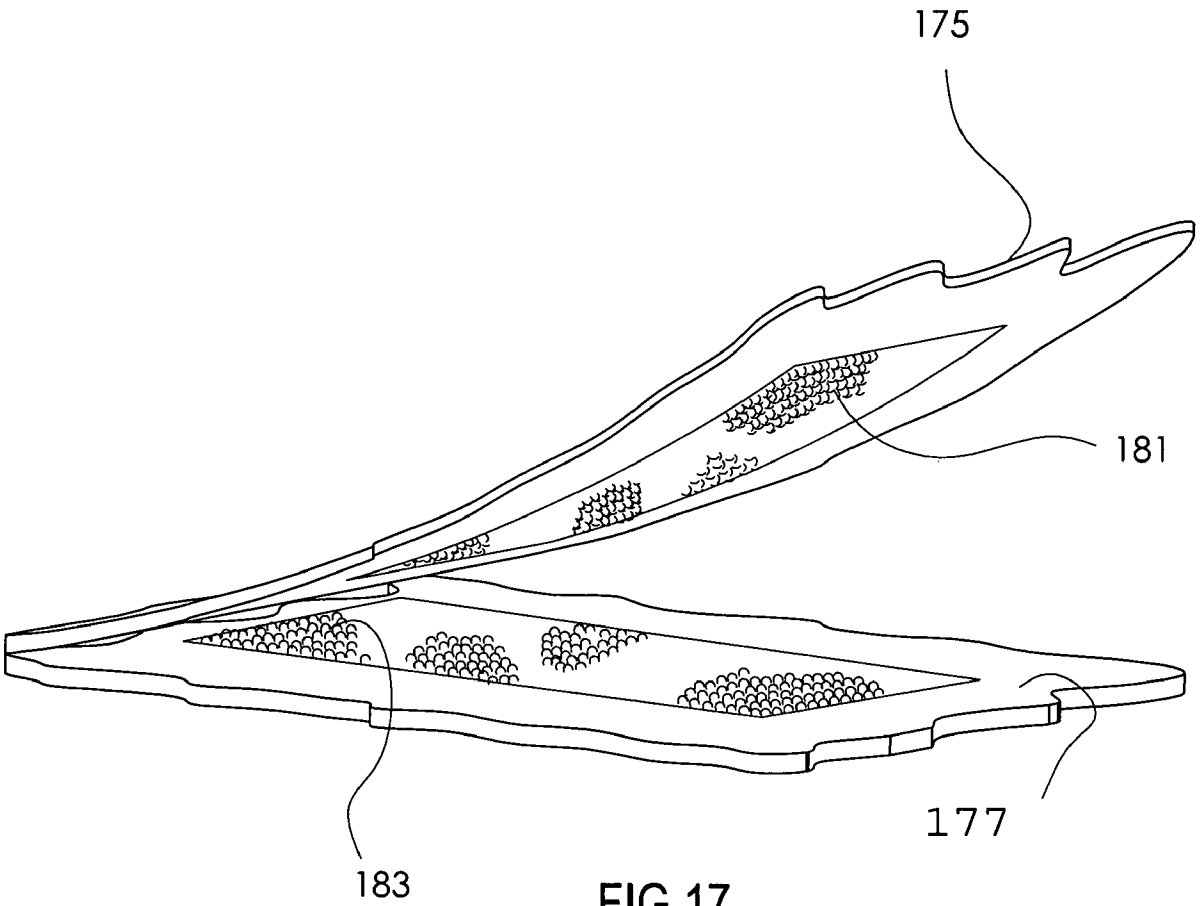
FIG. 17 is a detail view of a sleeve attached to a sheet using hooks and loops.

FIG. 17 is a perspective cutaway view of a sleeve 175 attached to a sheet 177 using hooks 181 and loops 183. Hooks 181 and loops 183 may be attached to either sleeve 175 or sheet 177, however, where loops 183 are located on safety sheet 177 rather than sleeve 175, safety sheet 177 may be more readily usable as a regular (non-safety) sheet.

Figure 18:
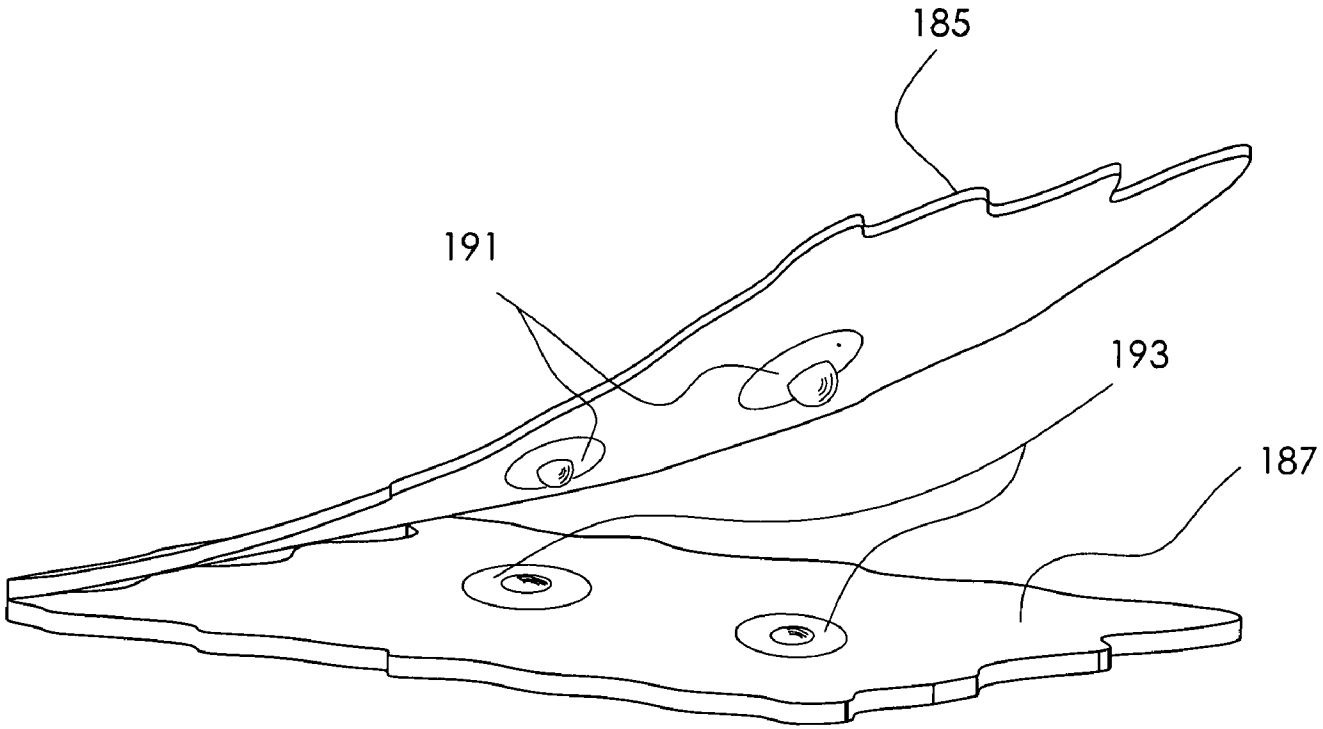
FIG. 18 is a detail view of a sleeve attached to a sheet using snap-fit devices including studs and sockets.

FIG. 18 is a perspective cutaway view of a sleeve 185 attached to a sheet 187 using snap-fit devices which include studs 191 and sockets 193. Although studs 191 and sockets 193 may be located on either safety sheet 187 or sleeve 185, safety sheet 187 as shown with sockets 193 attached may be more readily useable as a regular (non-safety) sheet (which may be fitted) when a safety sheet is no longer needed.

Any of the safety sheets illustrated herein may be reversed to conceal the sleeves and inserts and/or to make for a smooth sleeping surface. Additionally, when inserts are no longer needed (such as when a child outgrows the need for lateral barriers while sleeping), the safety sheet may be used without inserts as a regular (non-safety) bedsheet would be used and may be reversible to conceal the sleeves if desired. Additionally, although safety sheets 21 and 81 are illustrated as generally rectangular, they may be any shape, including circular, and the accompanying inserts may be constructed of a material which is flexible enough to arc without breaking yet still provide protection from falls that result from lateral movement over the side of a mattress.

Finally, although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A safety sheet for a mattress comprising:

a reversible fitted sheet for a mattress;

a fitted sheet main surface;

a first side adjacent said fitted sheet main surface, a second side adjacent said fitted sheet main surface and oppositely disposed from said first side, a first end adjacent fitted sheet main surface and extending between said first and second sides, and a second end oppositely disposed from said first end and extending between said first and second sides;

a first sleeve attached to said fitted sheet main surface along a first line located inwardly from, and generally parallel to, said first side of said safety sheet at a first distance of generally the width of said first sleeve, wherein said first sleeve is defined by a first fold of a first generally rectangular pattern having a first lateral edge and a second lateral edge, such that said first and second lateral edges of said first sleeve are coupled one to another and joined to said fitted sheet along said first line, and wherein said first sleeve is thereby flappable inwardly and outwardly from said first line, wherein said first sleeve includes a first end and a second end, and wherein the axial profile of said first sleeve is closed perimeter for at least a first portion of the length of said first sleeve;

a second sleeve attached to said fitted sheet main surface along a second line located inwardly from, and generally parallel to, said second side of said safety sheet at a second distance of generally the width of said second sleeve, wherein said second sleeve is defined by a second fold of a second generally rectangular pattern having a third lateral edge and a fourth lateral edge such that said third and fourth lateral edges of said second sleeve are coupled one to another and joined to said fitted sheet along said second line wherein said second sleeve is thereby flappable inwardly and outwardly from said second line; wherein said second sleeve includes a third end and a fourth end, and wherein the axial profile of said second sleeve is closed perimeter for at least a second portion of the length of said second sleeve;

a first removable insert fittable into said first sleeve to restrict lateral movement of an occupant upon the fitted sheet main surface; and a second removable insert fittable into said second sleeve to restrict lateral movement of said bed's occupant;

wherein said reversible fitted sheet for a mattress is adapted for operative interchangeable use in a reversed format and without the first and second removable inserts.

2. The safety sheet recited in claim 1, further comprising:

a third sleeve attached to said fitted sheet main surface along a third line located inwardly from, and generally parallel to, said first end of said safety sheet at a third distance of generally the width of said third sleeve, wherein said third sleeve is defined by a third fold of a third generally rectangular pattern having a fifth lateral edge and a sixth lateral edge, such that said fifth and sixth lateral edges of said third sleeve are coupled one to another and joined to said fitted sheet along said third line, and wherein said third sleeve is thereby flappable inwardly and outwardly from said third line, wherein said third sleeve includes a fifth end and a sixth end, and wherein the axial profile of said third sleeve is closed perimeter for at least a third portion of the length of said third sleeve;

a fourth sleeve attached to said fitted sheet main surface along a fourth line located inwardly from, and generally parallel to, said second end of said safety sheet at a fourth distance of generally the width of said fourth sleeve, wherein said fourth sleeve is defined by a fourth fold of a fourth generally rectangular pattern having a seventh lateral edge and an eighth lateral edge such that said seventh and eighth lateral edges of said fourth sleeve are coupled one to another and joined to said fitted sheet along said fourth line and wherein said fourth sleeve is thereby flappable inwardly and outwardly from said fourth line, wherein said fourth sleeve includes a seventh end and an eighth end, and wherein the axial profile of said fourth sleeve is closed perimeter for at least a fourth portion of the length of said fourth sleeve;

a third removable insert fittable into said third sleeve to restrict movement of an occupant upon the fitted sheet main surface; and a fourth removable insert fittable into said fourth sleeve to restrict movement of said bed's occupant;

wherein said reversible fitted sheet for a mattress is adapted for operative interchangeable use in a reversed format and without the third and fourth removable inserts.

3. The safety sheet recited in claim 1 wherein said sleeves are elasticized.

4. The safety sheet recited in claim 3 wherein said sleeves are each attached to said safety sheet by at least one seam.

5. The safety sheet recited in claim 4 wherein said at least one seam is a sewn seam.

6. The safety sheet recited in claim 3 wherein said sleeves are each attached to said safety sheet by hooks and eyes.

7. The safety sheet recited in claim 3 wherein said sleeves are each attached to said safety sheet by at least one snap-fit device.

8. The safety sheet recited in claim 3 wherein said inserts are cylindrical.

9. The safety sheet recited in claim 3 wherein said inserts are cylindrical with a polygonal cross-section.

10. The safety sheet recited in claim 3 wherein said inserts are hollow.

11. The safety sheet recited in claim 3 wherein said inserts are solid.

12. The safety sheet recited in claim 3 wherein said inserts are inflatable.

13. The safety sheet recited in claim 3 wherein each of said sleeves includes at least one slit along its length.

14. The safety sheet recited in claim 3 wherein each of said sleeves includes at least one slot along its length.

* * * * *